US005701572A

United States Patent [19]

Behe et al.

[11] Patent Number: 5,701,572

[45] Date of Patent: Dec. 23, 1997

[54] CERAMIC COATED DETONING ROLL FOR XEROGRAPHIC CLEANERS

[75] Inventors: Thomas J. Behe, Webster; Daniel R. Gilmore, III, Victor; Bruce E. Thayer, Webster, all of N.Y.

[73] Assignee: Xerox Corporation, Stamford, Conn.

[21] Appl. No.: 517,024

[22] Filed: Aug. 18, 1995

[51] Int. Cl.[6] ..... G03G 21/00

[52] U.S. Cl. ..... 399/354; 15/256.51; 399/358

[58] Field of Search ..... 399/353–355, 399/357, 358; 15/256.51, 256.52

[56] References Cited

U.S. PATENT DOCUMENTS

| | | | |
|---|---|---|---|
| 4,835,807 | 6/1989 | Swift | 399/353 |
| 5,322,970 | 6/1994 | Behe et al. | 399/279 |
| 5,329,344 | 7/1994 | Gebasi et al. | 399/353 |
| 5,384,627 | 1/1995 | Behe et al. | 399/291 |
| 5,561,513 | 10/1996 | Lindblad | 399/354 |
| 5,597,419 | 1/1997 | Gerbasi et al. | 15/256.1 X |
| 5,600,414 | 2/1997 | Hyllberg | 399/176 |

*Primary Examiner*—William J. Royer
*Attorney, Agent, or Firm*—T. L. Fair

[57] ABSTRACT

An apparatus and method for removing particles from a cleaner brush used to clean a photoreceptive surface. The apparatus and method include a cleaning brush or other cleaning device and a ceramic coated detoning roll resistive to wear. The detoning roll consists of a low electrically conductive coating over a conductive substrate material having a short electrical relaxation time constant.

18 Claims, 3 Drawing Sheets

CERAMIC COATED DETONING ROLL FOR XEROGRAPHIC CLEANERS

BACKGROUND OF THE INVENTION

This invention relates generally to a cleaning apparatus, and more particularly concerns a ceramic coated detoning roll.

Current xerographic printers and copiers, such as Xerox machines 1075, 1090, and 5090, have cleaners that use an aluminum detoning roll with an approximately 50 micron anodized surface. The electrical properties of this coating are as such as to provide a dielectric constant that enables one to provide an electrical bias. It was intended that the anodized aluminum detoning roll last the life of the machine. However, some cleaners have shown that the rolls are wearing out prior to the machine life, requiring replacement of the entire cleaner. Based on field data, it has been estimated that a cleaner will have to be replaced at least twice during the life of the machine which can be very expensive.

The following disclosures may be relevant to various aspects of the present invention and may be briefly summarized as follows:

U.S. Pat. No. 5,384,627 to Behe et al. discloses a developer unit adapted to develop a latent image with toner particles. The unit includes a housing defining a chamber for storing a supply of toner particles in the chamber. The unit also includes a donor roll with a circumferential surface having a conductivity less than $10^{-8}$ (ohm-cm)$^{-1}$ and having a central region and opposed marginal regions. The donor roll is spaced from the latent image to form a development zone. The unit further includes an electrode member which is positioned in the development zone adjacent opposed marginal regions and spaced from the central regions of the donor roll. The electrode member is electrically biased to detach toner particles from the donor roll to form a toner powder cloud in the development zone with toner particles from the toner cloud developing the latent image.

U.S. Pat. No. 5,322,970 to Behe et al. discloses a donor roll for the conveyance of toner in a development system for an electrophotographic printer includes an outer surface of ceramic. The ceramic has a suitable conductivity to facilitate a discharge time constant thereon of less than 600 microseconds. The donor roll is used in conjunction with an electrode structure as used in scavengeless development.

SUMMARY OF INVENTION

Briefly stated, and in accordance with one aspect of the present invention, there is provided an apparatus for removing particles from an imaging surface, comprising: means for removing particles from the imaging surface; and means for detoning the particles from the removing means, the detoning means comprising a low electrically conductive surface having an abbreviated electrical time constant, the low electrically conductive surface being ceramic.

Pursuant to another aspect of the present invention, there is provided an electrophotographic printing machine of the type having an electrostatic latent image recorded on an imaging surface and a cleaning unit adapted to clean residual particles, remaining after transfer of the image, from the imaging surface, comprising: a cleaner brush for removing particles from the imaging surface; and a detoning roll for removing the particles from the cleaner brush, the detoning roll comprising a ceramic low electrically conductive circumferential surface to increase wear resistance of the detoning roll having an abbreviated electrical time constant.

Pursuant to another aspect of the present invention, there is provided a method of manufacturing a detoning roll for use in removing particles from a cleaning device, comprising: machining a material to form a generally cylindrical electrically conductive substrate; and coating the conductive substrate with a ceramic low electrically conductive layer resistive to wear having an abbreviated electrical relaxation time constant.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
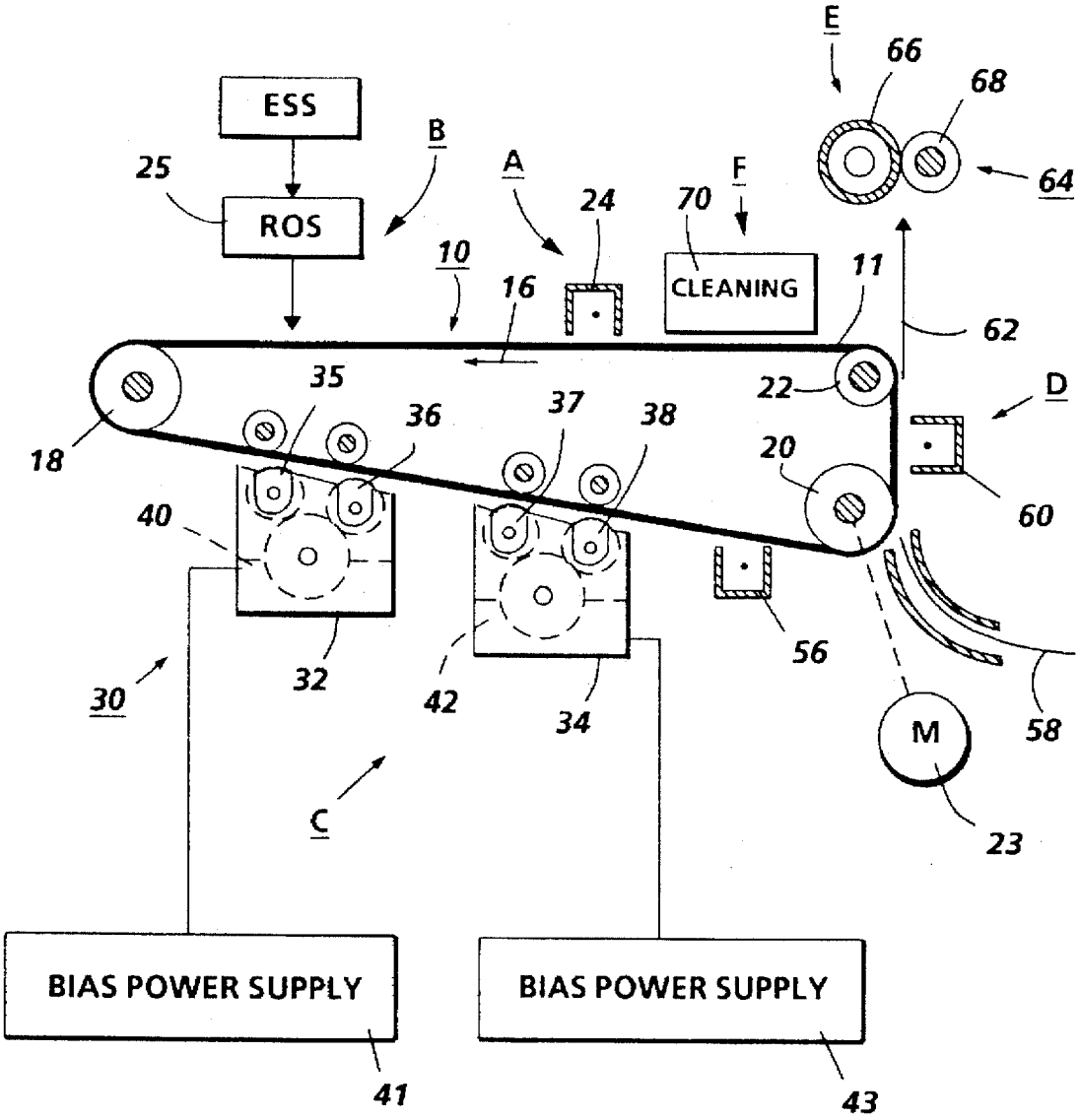
FIG. 4 is a schematic illustration of a printing apparatus incorporating the inventive features of the present invention.

Referring now to the drawings, where the showings are for the purpose of describing a preferred embodiment of the invention and not for limiting same, the various processing stations employed in a reproduction machine illustrated in FIG. 4 will be briefly described.

A reproduction machine, in which the present invention finds advantageous use, utilizes a charge retentive member in the form of a photoconductive belt 10 consisting of a photoconductive surface 11 and an electrically conductive, light transmissive substrate mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoconductive belt 10. Roller 20 is coupled to motor 23 by suitable means such as a belt drive. Motor 23 rotates roller 20 to advance belt 10 in the direction of arrow 16.

As can be seen by further reference to FIG. 4, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. The scanning device is a three level laser Raster Output Scanner (ROS). The resulting photoreceptor contains both charged-area images and discharged-area images.

At development station C, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, are removed at cleaning station F with a cleaning system 70.

Figure 1:
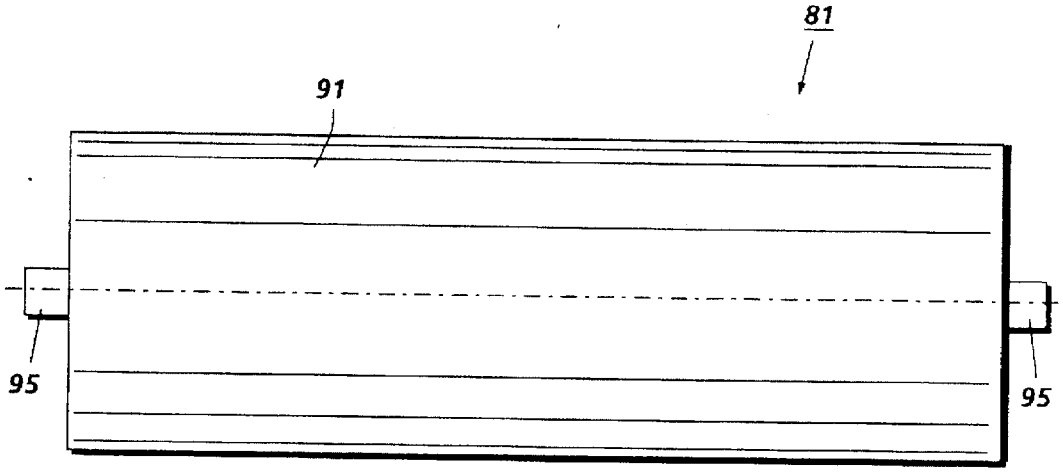
PRIOR ART FIG. 1
FIG. 1 is a plan view of a prior art detoning roll.

Reference is now made to FIG. 1, which shows a plan view of a prior art detoning roll. The detoning roll 81 includes a core shaft 95 through a conductive detoning roll 91. Some such detoning rolls may have anodized surfaces.

Figure 2:
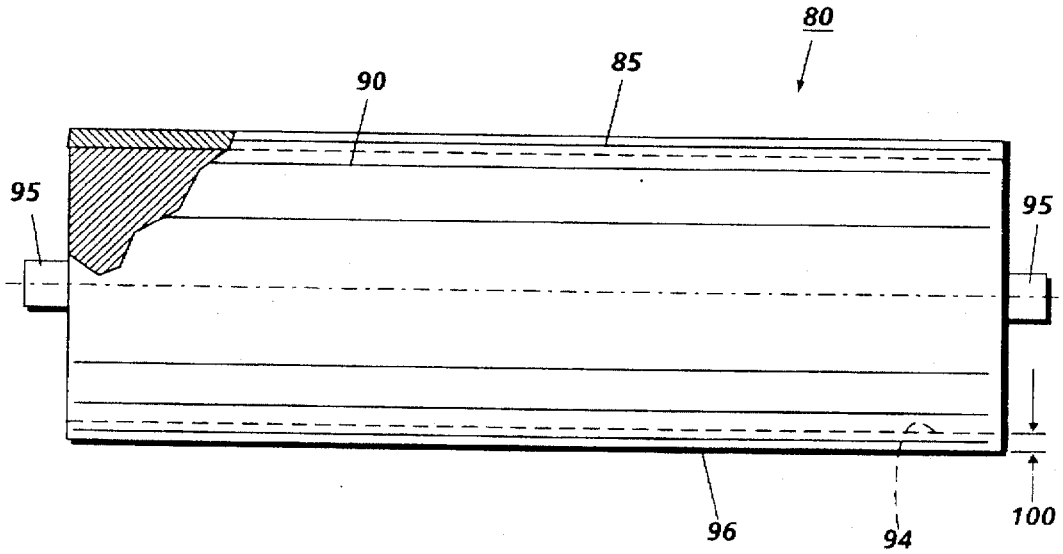
FIG. 2 is a plan view of an embodiment of the detoning roll in the present invention.

Reference is now made to FIG. 2, which shows a plan view of an embodiment of the present invention. The detoning roll 80 includes a core shaft 95, a conductive core 90 and a ceramic low electrically conductive (i.e. high resistance) surface 85.

With continued reference to FIG. 2, The detoning roll 80 preferably has a generally cylindrical elongated shape. The detoning roll 80 includes an electrically conductive substrate 90 which preferably is in the form of a cylindrical tube. It should be appreciated, however, that the electrically conductive substrate 90 may take any other suitable form including a solid cylinder. The electrically conductive tube 90 may be made of any suitable conductive material, such as aluminum. The cylindrical tube 90 may be fabricated by any suitable method such as machining or by extruding, but machining may be preferred to assure dimensional accuracy. A layer 85 of a low electrically conductive material is located on tube periphery 94 of the electrically conductive substrate 90. The low electrically conductive layer 85 defines a layer periphery 96. The low electrically conductive layer 85 may be made of any suitable material but preferably is made of a material which has a conductivity less than about $10^{-8}$ (ohm-cm)$^{-1}$, and an electrical relaxation time constant of less than about 1 millisecond. The time constant ($\tau$) is approximately less than one-third of the time it takes the detoning roll to pass through the brush/detoning roll nip (i.e. the brush/detoning roll nip is where the brush fibers are in contact with the detoning roll surface). The electrical relaxation time constant is fast enough (e.g. abbreviated or short) to allow the detoning field to be high enough through a sufficient portion of the detoning roll nip to adequately detone the cleaning brush (i.e. the detoning field ($V_t$) is defined as:

$$\Delta V=(1-e^{-t/\tau})$$

where $\Delta V$ is the difference between the brush core voltage and the detoning roll core voltage; t is the time after entering the brush/detoning roll nip. Preferably, the layer 85 is made of a material which may be applied to the tube periphery 94 with a low electrically conductive layer thickness 100 defined by the distance between the tube periphery 94 and the layer periphery 96 sufficient to permit the subsequent machining of the layer 85.

Preferably, the low electrically conductive layer 85 of the present invention is made of a ceramic material. A ceramic is a non-metallic, inorganic compound normally comprised of a blend of pure oxide ceramics such as alumina, zirconia, thoria, beryllia, magnesia, spinel, silica, titania, and forsterite, which may be applied as a film to a metal substrate. Ceramics which include at least one of aluminum (Al), boron (B), carbon (C), germanium (Ge), silicon (Si), titanium (Ti), zirconium (Zr), magnesium (Mg), beryllium (Be) and tungsten (W) are particularly hard, highly abrasion resistive, have high resistivity, high dielectric strength, low dielectric loss, and a high dielectric constant and are, therefore, preferred for the detoning roll low electrically conductive layer 85. The material properties of the ceramic are chosen to obtain a preselected conductivity of preferably less than $10^{-8}$ (ohm-cm)$^{-1}$.

The ceramic layer 85 may be applied to an aluminum tube 90 by any suitable process such as sputtering, ion-plating, vacuum evaporation or plasma spraying. Plasma spraying is preferred for optimum control of the properties of the aluminum tube 90 and the ceramic layer 85.

Figure 3:
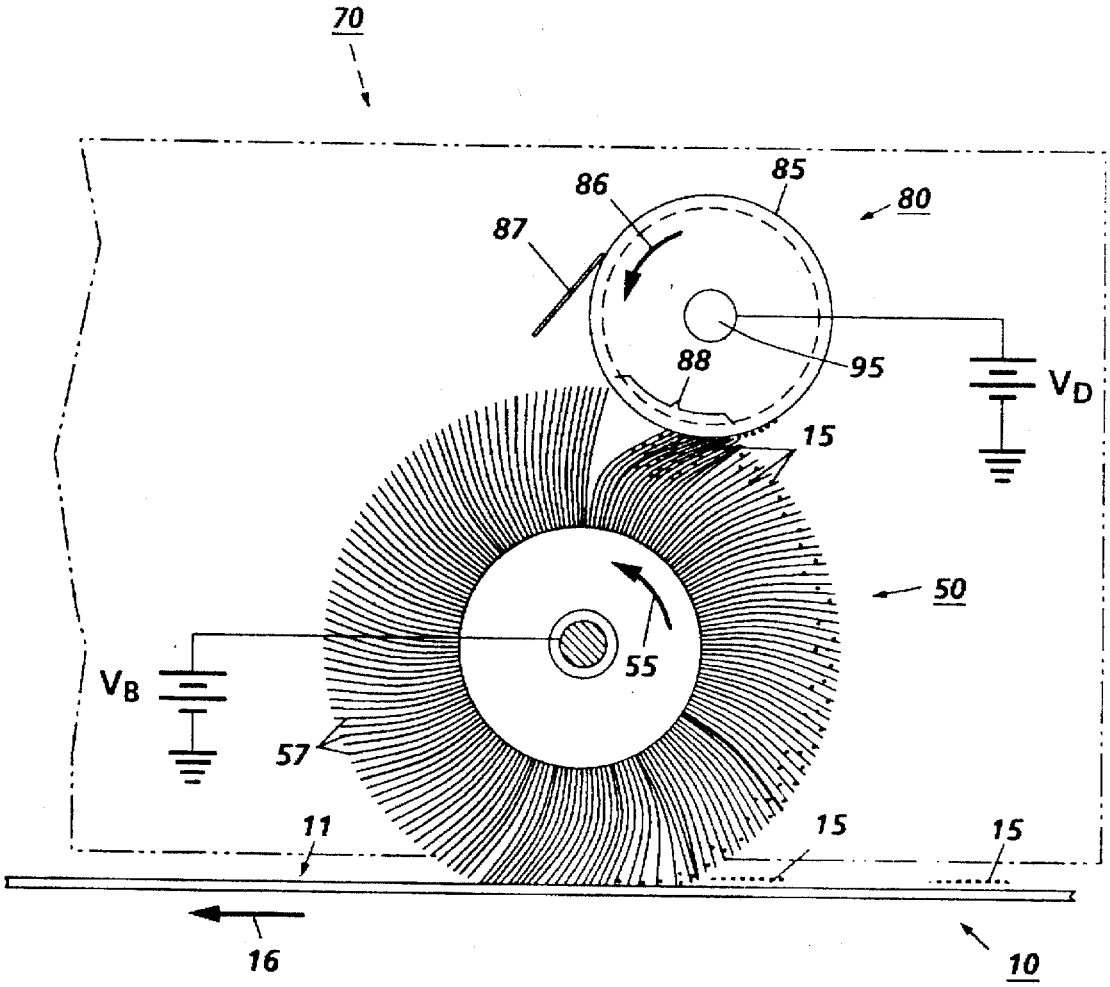
PRIOR ART FIG. 3
FIG. 3 is a prior art elevational schematic view of the detoning roll rotating in the same direction as the cleaner brush.

Reference is now made to FIG. 3, which shows a schematic elevational view of the detoning roll adjacent to a brush cleaner. The detoning roll 80, rotates in a direction shown by arrow 86. The brush 50 rotates in a direction, shown by arrow 55, to remove toner particles 15 from the photoconductive surface 11. The photoconductive 10 moves in the direction shown by arrow 16. The toner 15 can be removed from the brush fibers 57 by a detoning field in the detoning nip 88. The toner particles 15, attracted to the detoning roll 80, are removed from the detoning roll 80 by a scraper blade 87, shown here in the doctoring mode.

With continuing reference to FIG. 3, brush detoning takes place when potentials (i.e. $V_B$, $V_D$) are applied to the brush 50 (e.g. $V_B$ is about +200 volts) and the detoning roll 80 (e.g. VD is about +500 volts) to attract the toner particles 15 (having negative charge) from the brush 50 to the detoning roll 80. This produces a detoning field between the brush 50 and the detoning roll 80 (e.g. equal to about 300 volts).

There are several advantages using a ceramic coated detoning roll of the present invention. These advantages over anodized detoning rolls include: less roll and scraper wear; no pin holes; higher breakdown voltage for higher detoning electrical fields; predictable manufacturing process (i.e. low reject rate eliminates need for 100% inspection) and electrical properties remain stable with changes in relative humidity. Additionally, the ceramic coated detoning rolls are mechanically tougher than anodized aluminum, making the ceramic coated detoning rolls less susceptible to damage during handling and shipping, and more wear resistant during detoning of a cleaner brush. The longer detoning roll life reduces the service costs associated with the cleaning subsystem.

Another advantage of the present invention, is that the pin hole defects and voids associated with anodized aluminum detoning rolls are significantly reduced or entirely eliminated with a ceramic coating over the anodized aluminum. The maximum thickness coating that can reliably be achieved with anodization is 0.003 inches. Variations in the anodization thickness can result in shorting to the substrate. In the present invention, the ceramic coating can be plasma sprayed in thickness from 0.005 inches to 0.100 inches, thereby eliminating problems with the substrate surface structure.

Another advantage is that the ceramic coatings in the present invention have conductivities and dielectric constants better than anodization. Voltage breakdowns at approximately 500 volts per 0.001 inches thickness allow for higher biases to be applied, possibly resulting in better performance. In addition, anodization is susceptible to changes in relative humidity, requiring special sealants. While additional testing is required, initial testing of ceramic detoning rolls does not show any adverse reaction to humidity shifts resulting in changes of electrical characteristics.

Furthermore, improved mechanical tolerances can be achieved using the present invention. After the roll is sprayed, it is ground to the desired diameter.

In recapitulation, ceramic coating of the detoning roll increases the wear resistance of the detoning roll surface, thereby increasing the detoning roll life. Several advantages result from the present invention. The detoning roll surface is tougher than commonly used anodized detoning rolls. The number of pin hole defects and voids associated with anodized aluminum detoning rolls are reduced. The conductivity and dielectric constant of the ceramic coating is better than that of anodized aluminum. And, better mechanical tolerances can be achieved with the present invention.

It is, therefore, apparent that there has been provided in accordance with the present invention, a ceramic coated detoning roll that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from an imaging surface, comprising:

means for removing particles from the imaging surface; and means for detoning the particles from said removing means, said detoning means comprising a low electrically conductive surface having an abbreviated electrical relaxation time constant, said low electrically conductive surface being ceramic.

2. An apparatus as recited in claim 1, wherein said low electrically conductive surface being ceramic increases wear resistance of said detoning means.

3. An apparatus as recited in claim 2, wherein said detoning means and said removing means are positioned adjacent to one another.

4. An apparatus as recited in claim 3, wherein said detoning means comprises a detoning roll.

5. An apparatus as recited in claim 4, wherein said removing means comprises a brush.

6. An apparatus as recited in claim 5, wherein said detoning roll comprises said low electrically conductive surface about a circumferentially situated conductive substrate.

7. An apparatus as recited in claim 6, wherein said low electrically conductive surface, circumferentially situated about the conductive substrate, comprises a conductivity of less than about $10^{-8}$ (ohm-cm)$^{-1}$.

8. An apparatus as recited in claim 7, wherein said detoning roll and said brush are movable independent of one another.

9. An apparatus as recited in claim 8, wherein said detoning roll and said brush comprise a brush-detoning roll nip where said detoning roll and said brush are in contact with one another.

10. An apparatus as recited in claim 9, wherein said abbreviated electrical relaxation time constant being approximately less than one-third of a time required for said detoning roll to move through said brush-detoning roll nip.

11. An apparatus as recited in claim 10, wherein said ceramic is chosen from a group of materials consisting of alumina, zirconia, thoria, beryllia, magnesia, spinel, silica, titania, and forsterite.

12. An electrophotographic printing machine of the type having an electrostatic latent image recorded on an imaging surface and a cleaning unit adapted to clean residual particles, remaining after transfer of the image, from the surface, comprising:

a cleaner brush for removing particles from the imaging surface; and a detoning roll for removing the particles from said cleaner brush, said detoning roll comprising a low electrically conductive circumferential surface to increase wear resistance of said detoning roll having an abbreviated electrical relaxation time constant.

13. A cleaning unit as recited in claim 12, wherein said detoning roll and said cleaner brush are positioned adjacent to one another, each having movement independent of one another.

14. A cleaning unit as recited in claim 13, wherein said detoning roll further comprises an electrically conductive substrate surrounded by said low electrically conductive circumferential surface.

15. A cleaning unit as recited in claim 14, wherein said low electrically conductive circumferential surface comprises a conductivity of less than about $10^{-8}$ (ohm-cm)$^{-1}$.

16. A cleaning unit as recited in claim 15, wherein said detoning roll and said brush comprise a brush-detoning roll nip where said detoning roll and said brush are in contact with one another.

17. A cleaning unit as recited in claim 16, wherein said abbreviated electrical relaxation time constant being approximately less than one-third of a time required for said detoning roll to move through said brush-detoning roll nip.

18. A cleaning unit as recited in claim 17, wherein said low electrically conductive circumferential surface is chosen from a group of materials consisting of alumina, zirconia, thoria, beryllia, magnesia, spinel, silica, titania, and forsterite.

* * * * *